United States Patent [19]

Dollst

[11] Patent Number: 4,774,769

[45] Date of Patent: Oct. 4, 1988

[54] APPARATUS FOR DRYING AND/OR WARMING SHOES

[76] Inventor: Klaus Dollst, Averhoffstrasse 24, D-2000 Hamburg 76, Fed. Rep. of Germany

[21] Appl. No.: 61,776

[22] Filed: Jun. 15, 1987

[30] Foreign Application Priority Data

Jun. 19, 1986 [DE] Fed. Rep. of Germany ..... 8616416

[51] Int. Cl.[4] ..... F26B 9/00

[52] U.S. Cl. ..... 34/60; 34/104; 422/125; 422/292; 422/300

[58] Field of Search ..... 422/123, 125, 305, 292, 422/300; 34/104, 60, 202

[56] References Cited

U.S. PATENT DOCUMENTS 1,109,771 9/1914 Legge ..... 12/114.2
2,173,528 9/1939 Beale ..... 422/292
2,942,090 6/1960 Diehl ..... 422/125

FOREIGN PATENT DOCUMENTS 113422 11/1983 European Pat. Off. .

*Primary Examiner*—Larry I. Schwartz
*Attorney, Agent, or Firm*—Staas & Halsey

[57] ABSTRACT

A device insertable into shoes is capable of drying, warming and disinfecting shoes. A perforated casing in the shape of a shoe interior holds an electric heater. The heater is powered by a power cord which extends from the casing. Arranged next to the heater is a receptacle for holding disinfectant. Heat from the heater evaporates the disinfectant, which is spread throughout the shoe through the perforations. A telescoping heel section ensures that the disinfectant will reach all sections of the shoe. A clip hingedly attached to the casing permits easy insertion and removal of the device from the shoe.

5 Claims, 1 Drawing Sheet

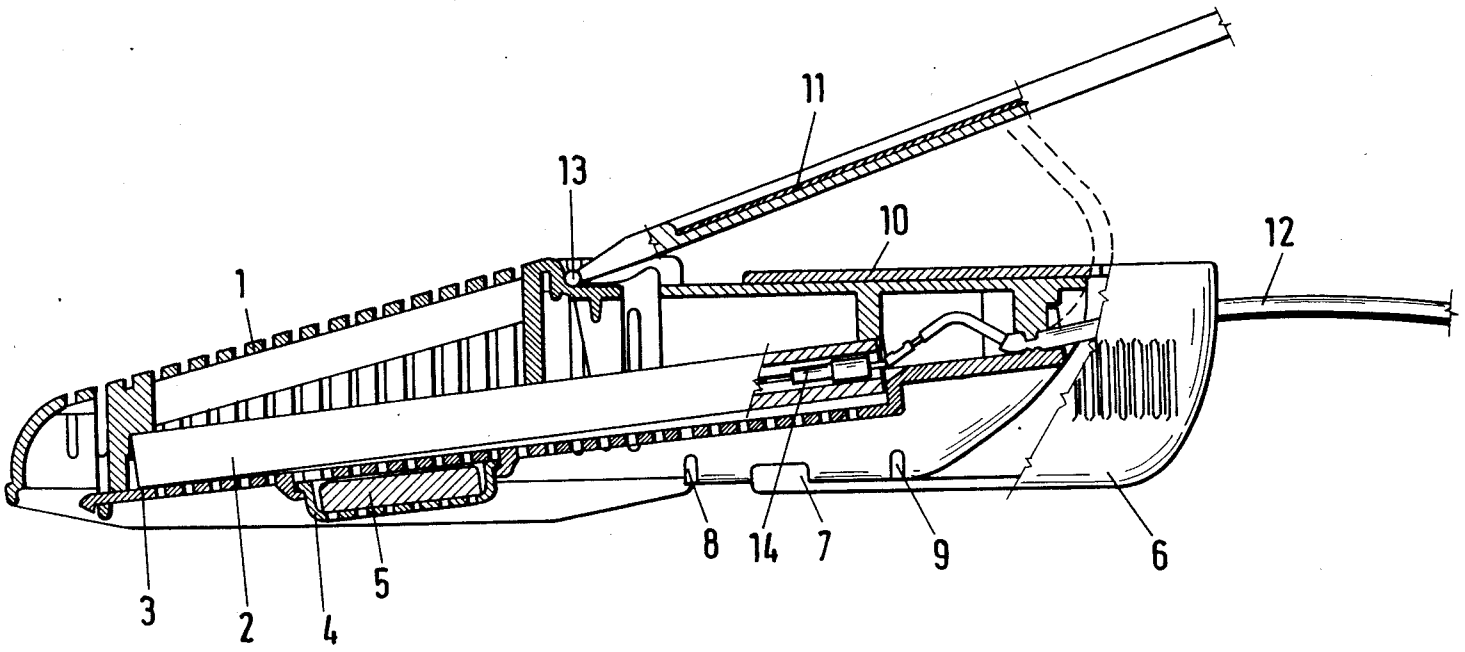
12
6
9
10
7
11
14
8
13
5
4
1
2
3

APPARATUS FOR DRYING AND/OR WARMING SHOES

BACKGROUND OF THE INVENTION

1. Field of the Invention

The invention relates to an apparatus for drying and/or warming shoes and disinfecting shoes.

2. Description of the Related Art

The inventors European patent application No. 0113 422 discloses an apparatus according to the preamble of claim 1. This apparatus is constructed in such a way that shoes can be both dried and stretched.

SUMMARY OF THE INVENTION

The object of the present invention is to provide an apparatus which, during drying and/or warming, permits disinfection, and therefore, more particularly, controls foot fungus bacteria in shoes.

According to the present invention a receptacle for a disinfectant is provided adjacent to or in the vicinity of a resistance heating means for evaporating the disinfectant. As a result of the special construction of openings and slits in the apparatus, it is ensured that the disinfectant is distributed in a shoe into which the apparatus is inserted in such a way that an optimum and complete disinfecting action is produced.

In order to improve this good, uniform and complete distribution of the disinfectant in the shoe, an extension piece is provided in the region of the apparatus corresponding to the heel of the shoe. The piece is telescopically displaceable. The extension piece ensures that the disinfectant also passes into the heel region and consequently into the complete shoe. Stops are provided for limiting the telescopic movement of the extension piece.

DESCRIPTION OF THE DRAWING AND PREFERRED EMBODIMENT

The invention is described in greater detail hereinafter relative to a non-limitative embodiment and the drawing showing an apparatus in longitudinal section.

The apparatus comprises a casing 1, which is provided with slits. The separately constructed base of the casing is designated as element 3. An electrical resistance heating means 2 is arranged in the casing, the power being supplied by means of a cable 12. A fuse 14 ensures that there is no overheating.

A clip 11 is fixed in articulated manner to a spring element at a joint 3. The electric cable 12 passes through the clip and is connected thereto (not shown). The clip can be roughly swung up vertically about the joint 13. Cable 12 is fixed to the clip and the casing at a length such that even when the clip 11 is turned up, adequate cable length is available. This ensures that no damage occurs even if the cable 12 is pulled for releasing from a shoe (not shown) into which the apparatus has been inserted.

A receptacle 4 for a disinfectant 5 is provided in the base 3. The receptacle 4 can easily be detached from the base 3, in order to receive the disinfectant 5, which can be in the form of a tablet or the like.

A telescopically displaceable extension piece 6 is provided on casing 1 in the heel region. The upper wall 10 of extension piece 6 serves as a guide. A stop 7 is provided on the extension piece 6 in the lower region and cooperates with two stops 8, 9 on the casing 1, in order to limit the telescopic movement. Together with the remainder of the hydraulic construction, this extension piece 6 ensures that when the disinfectant 5 is evaporated or vaporized, as a result of the heat from the resistance heating means 2, it is very uniformly distributed in the shoe, particularly also in the heel region thereof.

To place the apparatus into operation, the receptacle 4 is filled with a disinfectant table 5 and the apparatus is then placed in the shoe (not shown) with the aid of the clip 11. The extension piece 6 is then telescoped from the casing 1 into the heel region. The resistance heating means 2 is then supplied with power, so that heat is produced, and as a result the shoe is dried. Simultaneously, the disinfectant 5 evaporates or vaporizes, and the hydraulic construction of the slits and openings ensures a uniform distribution of the vaporized disinfectant throughout the shoe.

What is claimed is:

1. An apparatus for drying, warming and disinfecting a shoe, said apparatus comprising:

a perforated casing adapted to fit in the interior of the shoe;

heating means for heating the shoe, said heating means being arranged in said casing;

a clip for aiding in the removal and insertion of said apparatus from the shoe, said clip being hingedly connected to said casing; and a receptacle for holding disinfectant, said receptacle being arranged in said casing adjacent to said heating means so that the disinfectant placed in said receptacle is vaporized by heat from said heating means.

2. An apparatus according to claim 1, wherein said receptacle is provided in the vicinity of the bottom of said casing.

3. An apparatus according to claims 1 or 2, further comprising an extension piece telescopically displaceable on said casing, said extension piece being provided in the heel region so that the disinfectant is evenly distributed throughout the shoe.

4. An apparatus according to claim 3, further comprising stop means provided for limiting telescopic movement of said extension piece.

5. An apparatus according to claim 2, wherein vaporization of the disinfectant is controlled by supplying or not supplying power to said heating means.

* * * * *